US006079986A

United States Patent [19]

Beshears

[11] Patent Number: 6,079,986

[45] Date of Patent: Jun. 27, 2000

[54] STACKING COAXIAL CONNECTOR FOR THREE PRINTED CIRCUIT BOARDS

[75] Inventor: Gary A. Beshears, Greenwood, Ind.

[73] Assignee: Berg Technology, Inc., Reno, Nev.

[21] Appl. No.: 09/069,593

[22] Filed: Apr. 29, 1998

Related U.S. Application Data

[60] Provisional application No. 60/074,353, Feb. 7, 1998.

[51] Int. Cl.[7] ..... H01R 9/09

[52] U.S. Cl. ..... 439/63; 439/581

[58] Field of Search ..... 439/63, 581, 74

[56] References Cited

U.S. PATENT DOCUMENTS

| | | | |
|---|---|---|---|
| Re. 32,691 | 6/1988 | Dola et al. | 439/608 |
| 4,412,717 | 11/1983 | Monroe . | |
| 4,482,937 | 11/1984 | Berg | 361/413 |
| 4,506,939 | 3/1985 | Faulkenberry et al. . | |
| 4,603,926 | 8/1986 | Nesbit et al. . | |
| 4,645,288 | 2/1987 | Stursa . | |
| 4,684,200 | 8/1987 | Capp | 439/387 |
| 4,718,854 | 1/1988 | Capp et al. | 439/63 |
| 4,795,352 | 1/1989 | Capp et al. | 439/63 |
| 4,964,805 | 10/1990 | Gabany | 439/63 |
| 5,120,258 | 6/1992 | Carlton | 439/581 |
| 5,145,408 | 9/1992 | Houtteman et al. | 439/581 |
| 5,176,526 | 1/1993 | Hillbish | 439/74 |
| 5,192,230 | 3/1993 | Gabany et al. | 439/620 |
| 5,215,477 | 6/1993 | Weber et al. | 439/581 |
| 5,221,216 | 6/1993 | Gabany et al. | 439/620 |
| 5,334,029 | 8/1994 | Akkapeddi et al. . | |
| 5,380,211 | 1/1995 | Kawaguchi et al. | 439/74 |
| 5,411,409 | 5/1995 | Gray et al. | 439/329 |
| 5,516,307 | 5/1996 | Cartesse et al. | 439/581 |
| 5,580,276 | 12/1996 | Mussen | 439/581 |
| 5,641,294 | 6/1997 | Beard | 439/247 |
| 5,743,004 | 4/1998 | Chobot et al. | 439/74 |
| 5,768,106 | 6/1998 | Ichimura | 439/74 |

FOREIGN PATENT DOCUMENTS

| | | |
|---|---|---|
| 0 584 902 A1 | 3/1994 | European Pat. Off. . |
| 0 793 299 A1 | 2/1996 | European Pat. Off. . |

OTHER PUBLICATIONS

European Search Report Dated Mar. 25, 1999 for Application No. 99 10 1514.

*Primary Examiner*—Lincoln Donovan
*Assistant Examiner*—J. F. Duverne
*Attorney, Agent, or Firm*—Brian J. Hamilla; Daniel J. Long; M. Richard Page

[57] ABSTRACT

A low profile coaxial connector for at least three stacked boards (12, 14, 16) has a first part (20) with signal (22) and ground/shield (24) contacts to be secured on a first board (12). A second mating part (40) includes a signal contact (42) to be secured on an outermost (16) of the remaining circuit boards and a ground/shield contact (50) to be secured on an intermediate circuit board (14). The connector is especially useful when the intermediate circuit board constitutes a ground plane for shielding the first board, such as an electronics board, from the outermost circuit board, such as an antenna.

16 Claims, 5 Drawing Sheets

STACKING COAXIAL CONNECTOR FOR THREE PRINTED CIRCUIT BOARDS

RELATED APPLICATION

This application is based on Provisional Patent Application Ser. No. 60/074,353 filed Feb. 7, 1998.

BACKGROUND OF THE INVENTION

1. Field of the Invention

The present invention relates generally to an electrical connector, and more specifically to a coaxial connector for interconnecting three substantially parallel circuit boards. Specifically, this invention relates to a matched impedance coaxial connector system used to interconnect three printed circuit boards in a parallel configuration.

2. Reported Developments

High frequency signal transmission is essential in electronic appliances and equipment such as wireless communication equipment and laptop computers. In such low profile electronic appliances and equipment, it is typical to use a plurality of parallel substrates or circuit boards. In order to transmit wideband signals between such substrates with minimum signal distortion, it is typical to connect a coaxial connector on each substrate and interconnect such coaxial connectors with a proper length of coaxial cable or jumper cable.

Conventional coaxial connectors terminated to a cable have component count and require a relatively large space to accommodate the jumper cable that is needed. Also, the mating operation of the conventional coaxial connector is not easy and is time consuming. Additionally, such conventional coaxial connectors are not suited for compact and high density electronic appliances, especially having limited space and a low profile.

A more recent example of a coaxial connector is disclosed in U.S. Pat. No. 5,380,211 to Kawaguichi, which discloses a coaxial connector for directly connecting two parallel circuit boards without a cable. However, as equipment becomes faster and requires special circuit positioning, connecting three or more circuit boards may be necessary. A coaxial connector capable of interconnecting three or more circuit boards, therefore becomes desirable.

SUMMARY OF THE INVENTION

It is therefore an object of the present invention to provide a coaxial connector for connecting at least three substrates which requires less space, has a small component count, and is simple in construction and mating operation.

The present invention is a coaxial connector for electrically connecting signal and ground or shielding conductors of first, second and third circuit boards. A center contact assembly connects the signal and drive conductors together. The center assembly includes two mateable members that telescopically engage each other. A first member is preferably surface-mounted and electrically connectable with the signal conductors on the inner surface of the first circuit board. A second member is electrically connectable preferably by an interference press-fit connection, with signal conductors on the third circuit board. The coaxial connector also includes an outer contact assembly for connecting the ground conductors of the first and second circuit boards together. The outer assembly includes third and fourth mateable members that also telescopically engage each other. A third member is preferably surface-mounted and electrically connectable with the ground conductors on the first circuit board. A fourth member is electrically connectable preferably by a press-fit connection with the ground plane on the second circuit board. Insulator members are provided between the center and outer contact members.

DETAILED DESCRIPTION OF THE PREFERRED EMBODIMENTS

Figure 1:
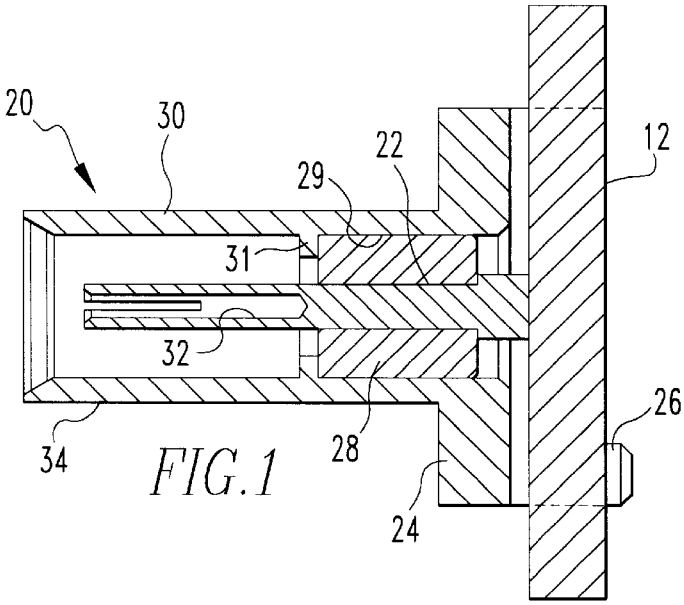
FIG. 1 is a cross sectional view of the receptacle portion of the coaxial connector, according to the invention, mounted on a first circuit board.
Figure 2:
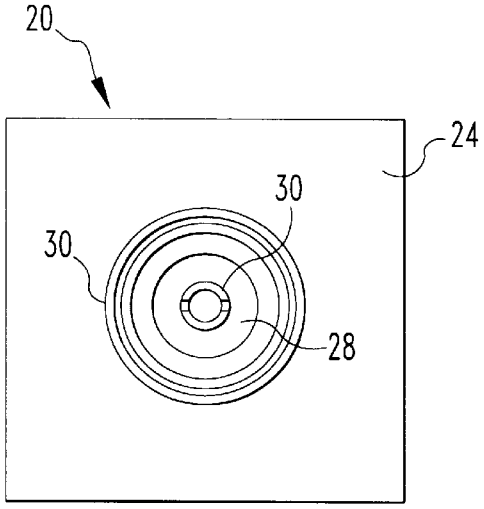
FIG. 2 is a top plan view of the receptacle portion of FIG. 1 before mounting.
Figure 3:
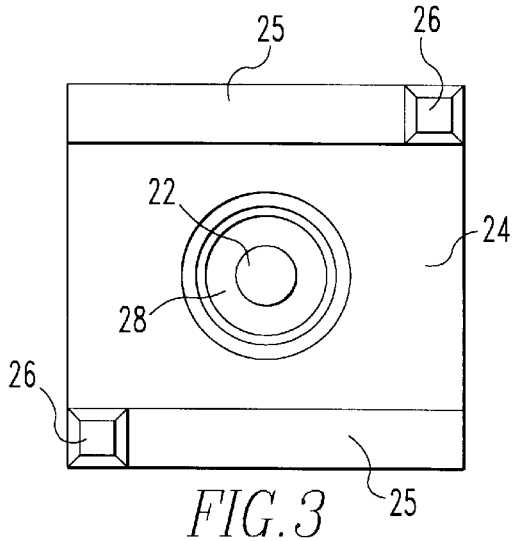
FIG. 3 is a bottom plan view of the receptacle portion of FIG. 1 before mounting.
Figure 4:
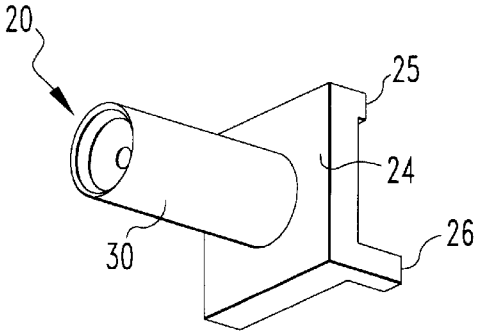
FIG. 4 is a perspective view of the receptacle portion of FIG. 1 from the top before mounting.
Figure 5:
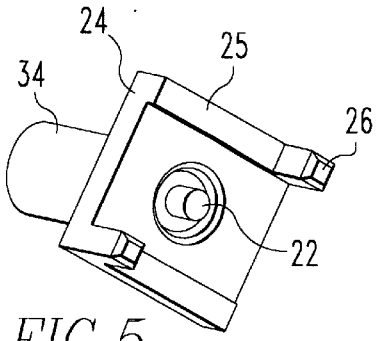
FIG. 5 is a perspective view of the receptacle portion of FIG. 1 from the bottom before mounting.
Figure 6:
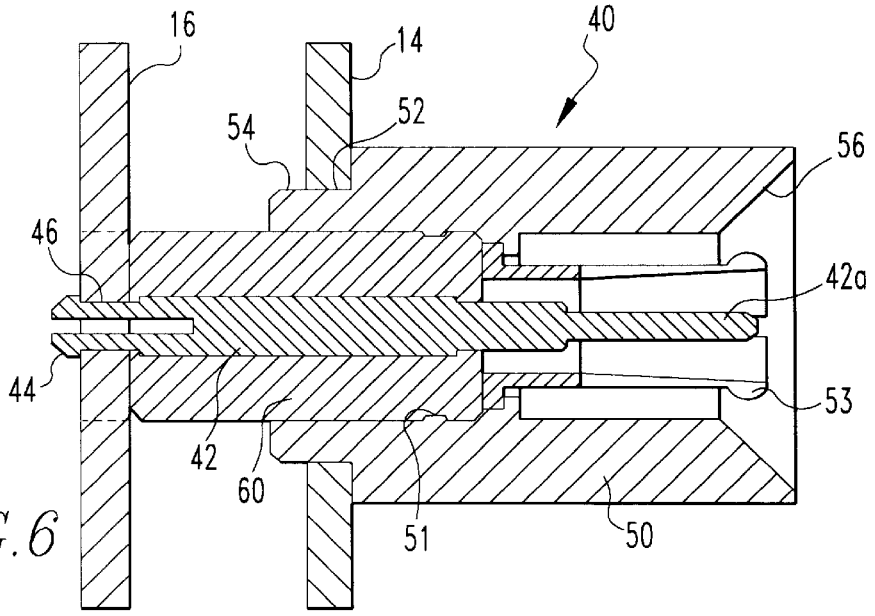
FIG. 6 is a cross sectional view of the plug portion of the coaxial connector according to the invention, mounted on second and third circuit boards.
Figure 7:
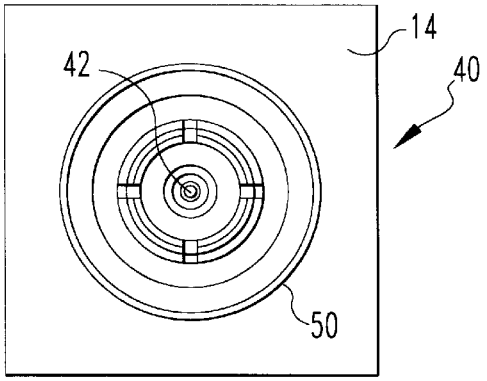
FIG. 7 is a top plan view of the plug portion of FIG. 6 mounted on the second circuit board.
Figure 8:
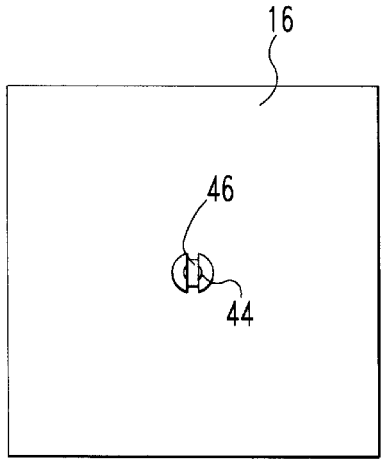
FIG. 8 is a bottom plan view of the third circuit board showing the end of the second contact member.
Figure 9:
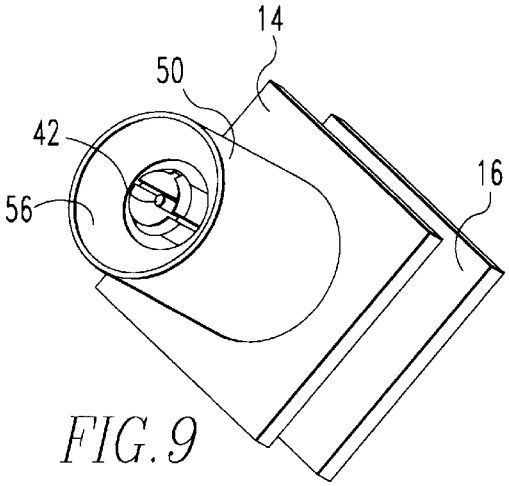
FIG. 9 is a perspective view from the top showing the receptacle portion of FIG. 6, mounted on the second and third circuit boards.
Figure 10:
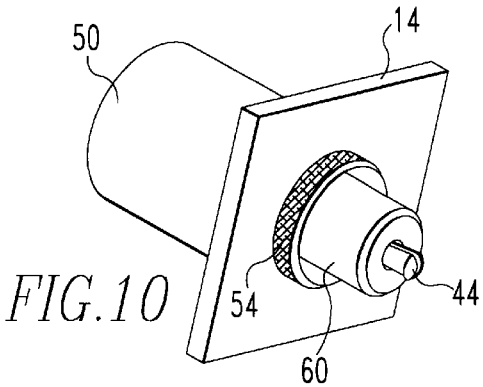
FIG. 10 is a perspective view from the bottom showing the plug portion of FIG. 6, mounted on only the second circuit board.

This invention provides a means of interconnecting high speed signals between printed circuit boards which are stacked in a parallel configuration while maintaining the desired signal integrity. As shown in the following embodiments, a 50 ohm matched impedance coaxial connector system provides for surface mount (SMT), press-fit or solder termination of the high speed signals between the electronics board and the signal or driver board as well as ground termination between the electronics board and the ground plane (i.e. the mid-plane). The disclosed invention is suitable for application in small, low profile electrical equipment such as wireless phones or set-top transceivers.

Referring now to FIGS. 1–5, the receptacle portion 20 of the coaxial connector, according to the invention, is shown surface mounted on a first circuit board 12, such as an electronics board. The center contact 22, such as a terminal jack receptacle, is also surface mounted to the board by a solder reflow process, for example. The center contact is made of high strength copper alloy.

The body 24 has rails 25, as opposed to pads, for surface mounting to the electronics board 12. The rails increase retention to the PCB, improve EMI performance and also improve manufacturability. Two offset locating and hold down posts 26 allow for proper location during the SMT process and also withstand bending forces resulting from blind mating misalignment.

A first insulator 28, preferable formed of a fluoropolymer, is provided between the central contact 22 and the body 24. The insulator is interference fit or otherwise retained in bore 29 against an annular shoulder 31. The center contact 22 is interference fit or otherwise retained into a generally central bore in insulator 28. The body 24 includes a substantially cylindrical mateable portion 30 extending beyond the insulator.

The receptacle 20 also has an extended wipe length 32 and 34 respectively, on both the central contact 22 and the mateable portion 30, to allow a wider tolerance for mating with the receptacle portion 40.

Referring to FIGS. 6–10, the plug portion 40 of the coaxial connector, according to the invention, is shown mounted to a second or mid-plane circuit board 14, such as a ground plane, and to a third circuit board 16, such as an antenna board. The receptacle center contact 42 has a split beam termination 44 for an interference press-fit connection to a through-hole 46 (preferably plated) in the antenna board 16. The outer contact 50 has a 360° interference press-fit ground to a hole 52 in the ground plane board 14 using a straight knurl 54, shown in FIGS. 6 and 10. The hole 52 may be plated to provide electrical continuity between the body 50 and a ground plane on circuit board 14.

An insulator 60 is retained on a central bore in one end of plug body 50. The insulator extends beyond one end of body 50 and essentially determines the stacked height between the ground plane board 14 and the antenna board 16. A metallic mating contact member 53 is fixed in the body 50. When the plug 40 and receptacle 20 are mated (FIG. 11), the reduced diameter fore portion 42*a* of contact 42 is received within the split, hollow fore portion of contact 22. Also, the contact member 53 is received within the interior bore of mateable portion 30 of receptacle 20.

A generous lead-in 56 allows for blind mateability, even if there is axial misalignment between the plug and receptacle.

Figure 11:
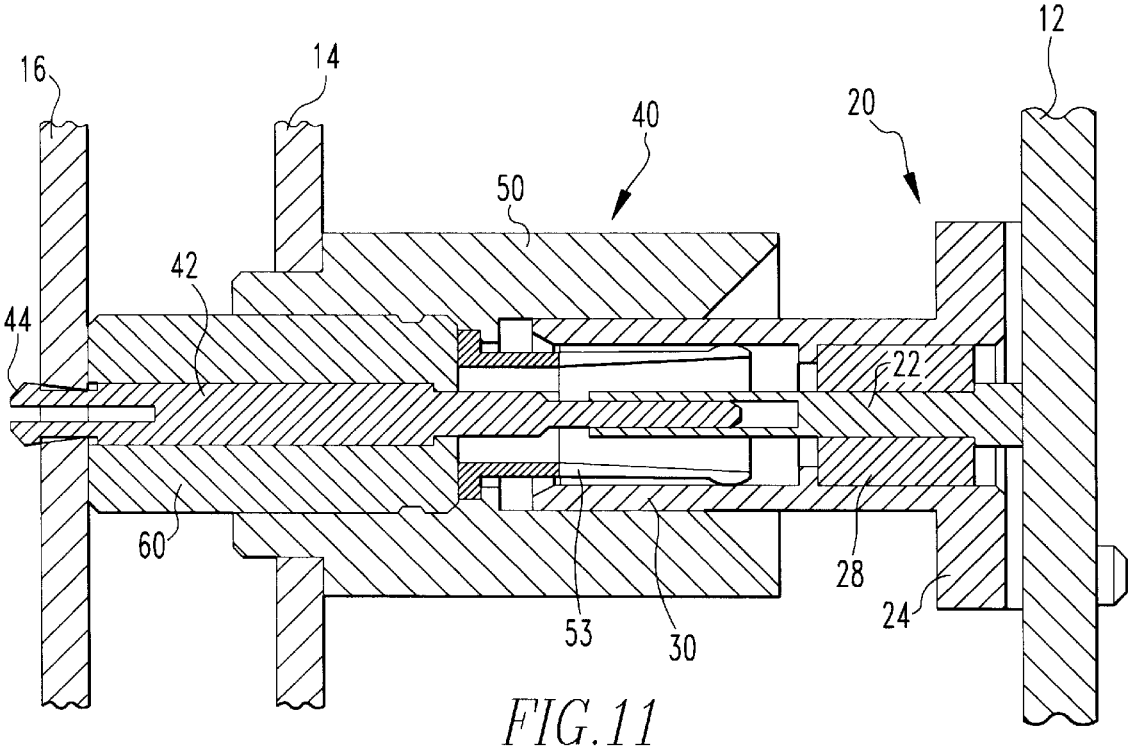
FIG. 11 is a cross sectional view of the mated plug and the receptacle portion of the coaxial connector, according to the invention, with the receptacle portion mounted on a first circuit board and the plug portion mounted on a second and third circuit board.
Figure 12:
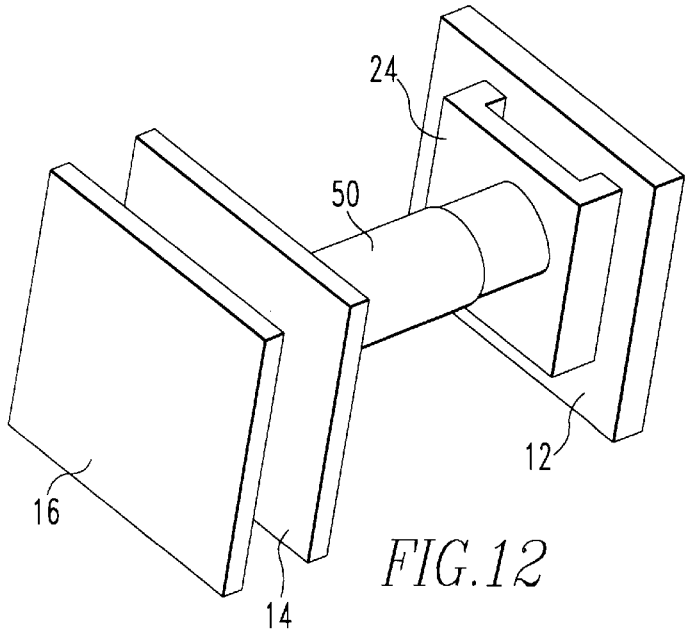
FIG. 12 is a perspective view of the mated connector in FIG. 11 from the plug end, showing the connector mounted to the first, second and third circuit boards.

The mated coaxial connector according to the preferred embodiment of FIGS. 1–10 are shown in FIGS. 11 and 12.

FIGS. 13–17 show alternative embodiments of the coaxial connector providing press-fit complaint pins instead of surface mounting and interference fits.

Figure 13:
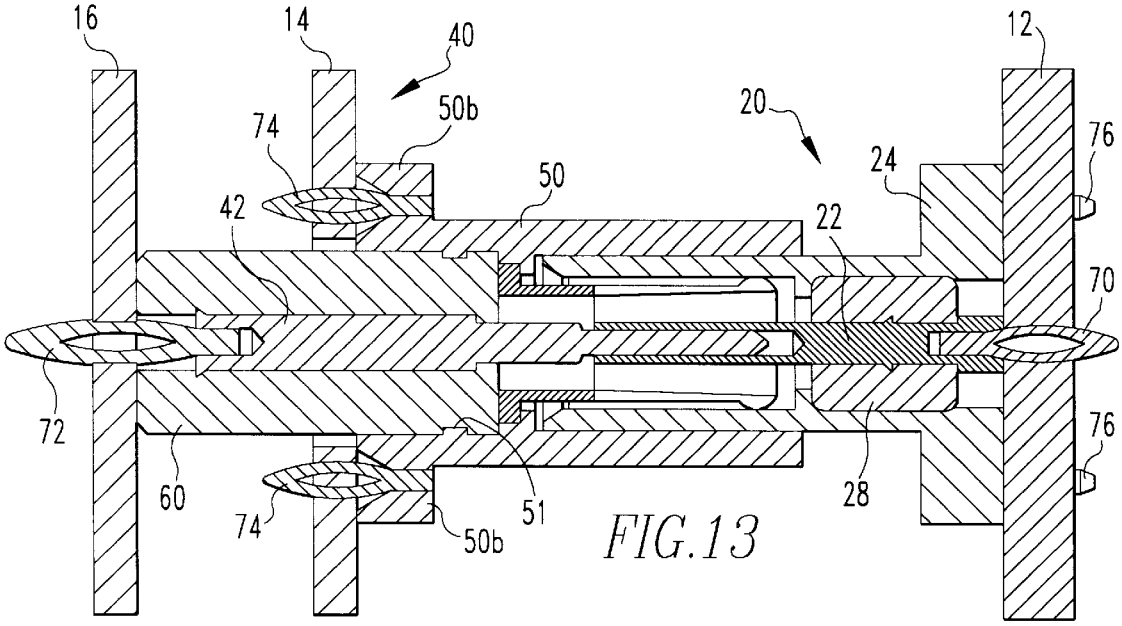
FIG. 13 is a cross sectional view of a mated plug and receptacle portion of a coaxial connector, according to another embodiment of the invention, showing the receptacle portion mounted on a first circuit board by press fit compliant pins in pre-drilled holes and the plug portion mounted on the second and third circuit boards by press fit compliant pins.

FIG. 13 illustrates an embodiment very similar to that shown in FIGS. 1–12, except that the connections of the various contact members with the printed circuit boards achieved by the use of press-fit pins. The body 24 of the receptacle 20 has been mounted thereon press-fit pins 76 engageable in plated through-holes in circuit board 12, for example, to electrically associate body 24 with grounds in the circuit board 12. The press-fit pins 76 can be in the form of a conventional eye of the needle press-fit section.

Similarly, the signal contact 22 has mounted in an end bore thereof a similar press-fit pin 70 for engaging a plated through-hole associated with a signal trace on the circuit board 12. The press-fit pins 70 and 76 also mount the receptacle 20 on the circuit board 12. The body 50 of plug 40 includes flanges or lugs 50*b* that carry similar press-fit pins 74 that engage plated through-holes in the circuit board 14, thereby providing the continuity of ground between circuit boards 12 and 14. A similar press-fit pin 72 is received in the end of contact 42 for electrically associating and mounting contact 42 on circuit board 16. The insulator 60 may be retained in body 50 by retention ring 51, by an interference fit, or by other suitable means.

Figure 14:
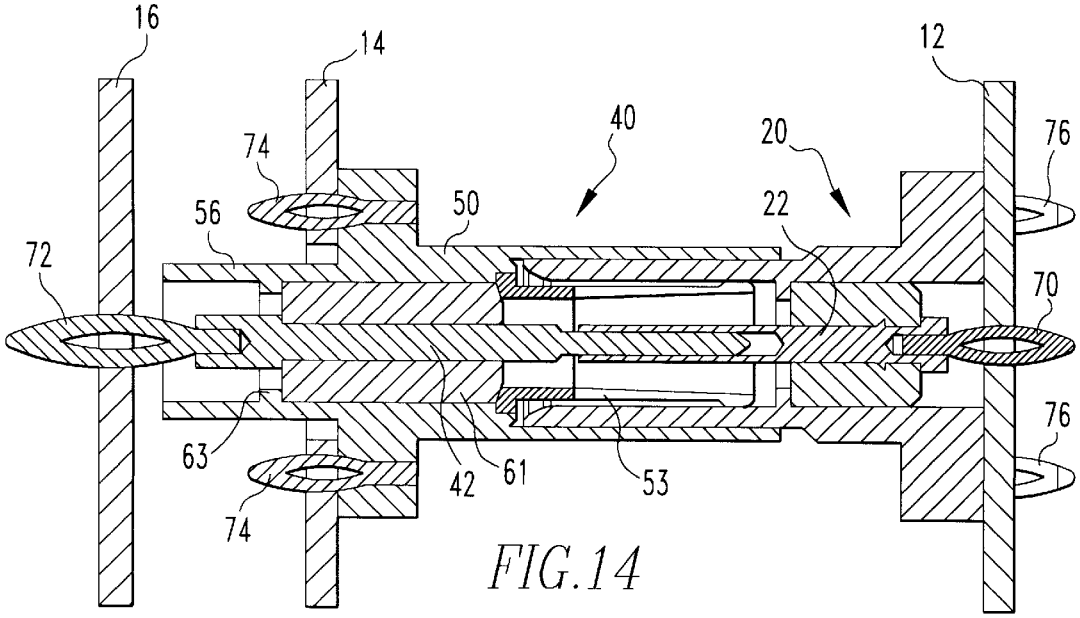
FIG. 14 is a cross sectional view similar to FIG. 13 of another embodiment of the invention.

FIG. 14 shows a somewhat different embodiment that also utilizes press-fit pins. This embodiment differs from that shown in FIG. 13 by having an extended section 56 extending toward the printed circuit board 16. The insulator 71 is correspondingly shortened. This embodiment extends the shielding of the contact 42 closer to circuit board 16.

Figure 15:
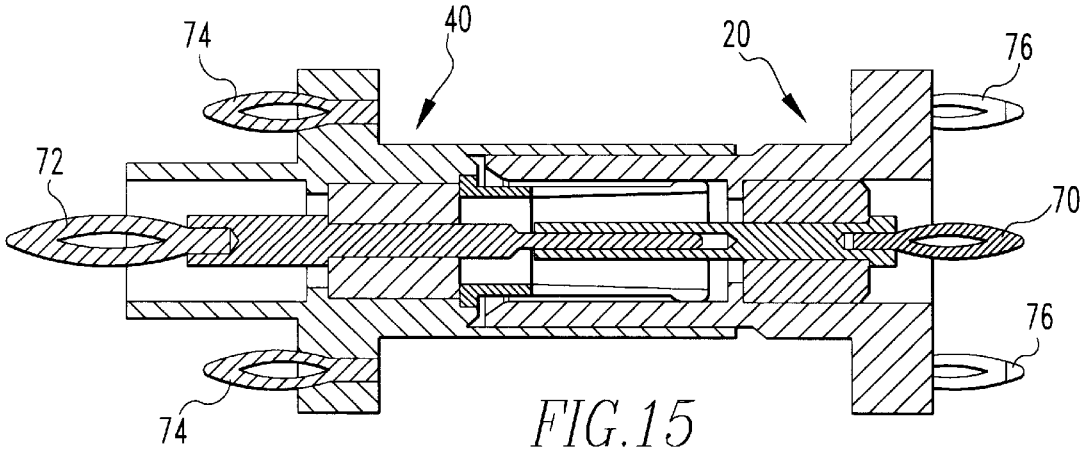
FIG. 15 is a cross sectional view of the embodiment of FIG. 14 prior to mounting on the first, second and third circuits boards.

FIG. 15 illustrates the embodiment of FIG. 15 prior to being attached to circuit boards.

Figure 16:
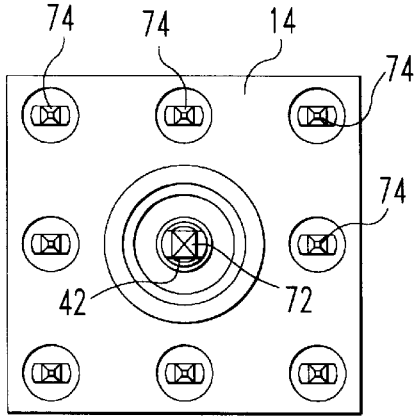
FIG. 16 is a bottom plan view of the coaxial connector in FIG. 15.

FIG. 16 is an end view of the embodiment in FIGS. 14 and 15 showing an array of press-fit pins 74 surrounding the signal contact 42.

Figure 17:
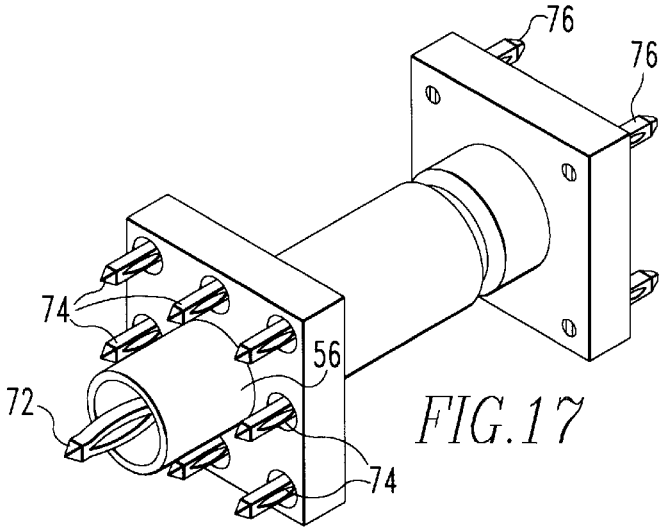
FIG. 17 is a perspective view from the bottom of the plug portion of the coaxial connector in FIG. 15.

FIG. 17 is an isometric view of the connector shown in FIG. 15.

As can readily be seen, a signal from circuit board 12 can be conducted to antenna board 16 through contacts 22 and 42. The connector bodies 24 and 50 and board 14 provide shielding for the signal as it passes between the printed circuit boards 12 and 14 and is radiated from board 16.

The disclosed invention is very well suited for low profile connection of three circuit boards in thin communications equipment, such as a wireless telephone, a set-top box or a laptop computer.

What is claimed is:

1. A coaxial connector for electrically connecting first, second and third mutually stacked, spaced circuit boards comprising:

a center contact assembly, said contact center assembly including mateable members that telescopically engage each other including:

a first member that is electrically connectable with signal conductors on a first circuit board and a second member electrically connectable with a conductor on the third circuit board; and an outer contact assembly for connecting ground conductors together, said outer assembly including mateable members that telescopically engage each other including:

third member that is mountable to and electrically connectable with conductors on the first circuit board and a fourth member electrically connectable with ground conductors on the second circuit board.

2. The coaxial connector of claim 1, further comprising a first and second insulator member, each respectively securing the first mateable member within the third member and the second mateable member within the fourth member.

3. The coaxial connector of claim 2, wherein the mateable members are cylindrical and one of said members has slots therein.

4. A coaxial connector for electrically connecting conductors on first, second and third circuit boards comprising:

a first center contact member having a first mateable contact section and a first conductor contact section for electrical connection to a signal conductor on the first circuit board;

a second center contact member having a second mateable contact section telescopically mateable with the first mateable contact section for electrical connection therebetween and a second conductor contact section extendable through the second circuit board for electrical connection to a conductor of the third circuit board;

a third outer contact member having a third mateable contact section and a third conductor contact section for electrical connection to a shielding conductor on the first circuit board; and a fourth outer contact member having a fourth mateable contact section telescopically mateable with the third mateable contact section for electrical connection therebetween and a fourth conductor contact section for electrical connection to a shielding conductor of the second circuit board.

5. The coaxial connector of claim 4, wherein the first center contact member is mounted in a first insulator body having opposed ends with said first mateable contact section extending from one end of the first insulator body and the first conductor contact section extending from the opposed end of the first insulator body.

6. The coaxial connector of claim 5, wherein the second center contact member is mounted in a second insulator body having opposed ends with the second mateable contact section extending from a first end of the second insulator body and the second actuator contact section extending from a second end of the second insulator body.

7. The coaxial connector of claim 6, wherein the second end of the second insulator body extends through the second circuit board.

8. The coaxial connector of claim 7, wherein a portion of the third conductor contact section surrounds the second end of the insulator body and extends through the second circuit board.

9. The coaxial connector as recited in claim 1, wherein said center contact assembly and said outer contact assembly generally electrically isolate said second circuit board from said third circuit board.

10. The coaxial connector as recited in claim 4, wherein said center contact assembly and said outer contact assembly generally electrically isolate said second circuit board from said third circuit board.

11. An electrical apparatus, comprising:

a plurality of stacked, spaced circuit substrates, comprising:

a first circuit substrate having a signal trace and a ground trace;

a second circuit substrate having a signal trace; and an intermediate circuit substrate located between said first and second circuit substrates and having an opening and a ground trace; and a coaxial connector interconnecting said first, second and intermediate circuit substrates and comprising:

a plug mounted to said first circuit substrate and having:

a center contact secured to said signal trace of said first circuit substrate and an outer contact secured to said ground trace of said first circuit substrate; and a receptacle mounted to said second and intermediate circuit substrates and having:

a center contact secured to said signal trace of said second circuit substrate and engageable with said center contact of said plug; and an outer contact secured to said ground trace of said intermediate circuit substrate and engageable with said outer contact of said plug.

12. The electrical apparatus as recited in claim 11, wherein said intermediate circuit substrate comprises a ground shield.

13. The electrical apparatus as recited in claim 12, wherein said second circuit substrate comprises an antenna.

14. The electrical apparatus as recited in claim 11, wherein said plug and said receptacle each further comprise an insulator positioned between said center contact and said outer contact.

15. The electrical apparatus as recited in claim 11, wherein said center contacts of said plug and said receptacle telescopingly receive one another, and said outer contacts of said plug and said receptacle telescopingly receive one another.

16. The electrical apparatus as recited in claim 11, wherein said second and intermediate circuit substrates are generally electrically isolated.

* * * * *

UNITED STATES PATENT AND TRADEMARK OFFICE

CERTIFICATE OF CORRECTION

PATENT NO. : 6,079,986

DATED : June 27, 2000

INVENTOR(S) : Beshears

It is certified that error appears in the above-indentified patent and that said Letters Patent is hereby corrected as shown below:

In the title (INID Code 54), delete "Stacking Coaxial Connector for Three Printed Circuit Boards" and insert therein -- Coaxial Connector for Multiple Stacked Printed Circuit Boards --

Signed and Sealed this

First Day of May, 2001

*Attest:*

Nicholas P. Godici

NICHOLAS P. GODICI

*Attesting Officer*

*Acting Director of the United States Patent and Trademark Office*